US006166481A

United States Patent [19]

Knapp et al.

[11] Patent Number: 6,166,481

[45] Date of Patent: Dec. 26, 2000

[54] ANTI-CARBON FOULING SPARK PLUG

[75] Inventors: Randy Owen Knapp, Central, S.C.; Daniel Lee Tribble, Holland; Robert Scott Ingham, Toledo, both of Ohio

[73] Assignee: Federal-Mogul World Wide, Inc., Southfield, Mich.

[21] Appl. No.: 09/247,913

[22] Filed: Feb. 11, 1999

[51] Int. Cl.[7] ..... H01T 13/20

[52] U.S. Cl. ..... 313/141; 501/14

[58] Field of Search ..... 313/141, 118; 501/14, 21; 428/702, 220

[56] References Cited

U.S. PATENT DOCUMENTS

| | | | |
|---|---|---|---|
| 4,746,578 | 5/1988 | Kondo et al. | 428/432 |
| 4,839,313 | 6/1989 | Kondo et al. | 501/14 |
| 5,518,968 | 5/1996 | Knapp | 501/14 |
| 5,677,250 | 10/1997 | Knapp | 501/14 |
| 5,922,444 | 7/1999 | Tsuzuki et al. | 428/220 |
| 5,985,473 | 11/1999 | Knapp et al. | 428/702 |

*Primary Examiner*—Frank G. Font
*Assistant Examiner*—Layla Lauchman
*Attorney, Agent, or Firm*—Reising, Ethington, Barnes, Kisselle, Learman & McCulloch, P.C.

[57] ABSTRACT

A spark plug (100) includes a ground electrode (125), a firing electrode (115), an insulator core (105) having an insulator core nose (120), and an outer shell (110) surrounding the insulator core (105). The improvement includes the insulator core nose (120) including a high temperature glaze applied to an outer surface of the insulator core nose (120) and the high temperature glaze composition. The composition includes, by weight:

(i) between about 72 and 84% $SiO_2$;

(ii) between about 10 and 20% $Al_2O_3$;

(iii) between about 2.0 and 2.5% $K_2O$;

(iv) between about 0.50 and 0.65% $Na_2O$;

(v) between about 3.0 and 5.5% CaO;

(vi) between about 0.1 and 0.25% MgO; and (vii) the remainder impurities.

19 Claims, 2 Drawing Sheets

ANTI-CARBON FOULING SPARK PLUG

TECHNICAL FIELD

The invention relates to a spark plug using a glazed core nose to prevent carbon buildup.

BACKGROUND OF THE INVENTION

A spark plug includes an outer shell and an insulator core assembly. A wire from a distributor or an electronic ignition system is attached at a first end of the spark plug. The second end of the spark plug projects into the combustion chamber of an engine when the spark plug is installed in the engine. The second end includes an insulator core nose from which a firing electrode protrudes. The firing electrode defines a spark gap with an adjacent ground electrode that protrudes from the outer shell.

In operation, the spark plug produces a spark in the spark gap. The insulator core nose and spark gap may become fouled by carbon buildup. This has the potential to cause a short between the two electrodes, which would prevent proper operation of the spark plug.

Carbon buildup may occur, for example, if the engine in which the spark plug is installed is run repeatedly for short periods of time without allowing the engine to heat up to a sufficient temperature to burn off carbon that builds up on the spark plug before the engine heats up. These conditions may occur during the production of an automobile, prior to delivery to the dealer. After the automobile is taken from the assembly line, the engine is started and the automobile is moved numerous times. Typically, the automobile is moved only a few feet and the engine is run only for a minute or less. The short time and distance does not provide sufficient running time to warm up the engine and burn off the carbon deposits. The engine may be run twenty times for very short periods during the automobile's production—potentially causing carbon buildup.

One solution to the problem of carbon buildup is to apply a temporary coating of silicone to the core nose to prevent the carbon from adhering to the core nose. The silicone coating burns off and exits the engine in the engine's exhaust gases after use at a normal operating temperature in which the core nose temperature rises to at least 700° F. This silicone in the exhaust gases may cause damage to oxygen sensors that are used to monitor emission levels.

BRIEF SUMMARY OF THE INVENTION

In one general aspect, a spark plug includes a ground electrode, a firing electrode, an insulator core having an insulator core nose, and an outer shell surrounding the insulator core. A high temperature glaze is applied to an outer surface of the insulator core nose. The glaze composition includes, by weight (i) between about 72 and 84% $SiO_2$; (ii) between about 10 and 20% $Al_2O_3$; (iii) between about 2.0 and 2.5% $K_2O$; (iv) between about 0.50 and 0.65% $Na_2O$; (v) between about 3.0 and 5.5% CaO; (vi) between about 0.1 and 0.25% MgO; and (vii) the remainder impurities.

In another general aspect, a ceramic insulator core nose has a high temperature glaze on an outer surface. The glaze composition includes, by weight: (i) between about 72 and 84% $SiO_2$; (ii) between about 10 and 20% $Al_2O_3$; (iii) between about 2.0 and 2.5% $K_2O$; (iv) between about 0.50 and 0.65% $Na_2O$; (v) between about 3.0 and 5.5% CaO; (vi) between about 0.1 and 0.25% MgO; and (vii) the remainder impurities.

In another general aspect, a spark plug having a high temperature glaze applied to an insulator core nose is made by providing an outer shell, providing an insulator core having the insulator core nose, providing the high temperature glaze, and inserting the insulator core in the outer shell. The high temperature glaze than is applied to the insulator core nose. The high temperature glaze includes, by weight: (i) between about 72 and 84% $SiO_2$; (ii) between about 10 and 20% $Al_2O_3$; (iii) between about 2.0 and 2.5% $K_2O$; (iv) between about 0.50 and 0.65% $Na_2O$; (v) between about 3.0 and 5.5% CaO; (vi) between about 0.1 and 0.2% MgO; and (vii) the remainder impurities.

The anti-carbon spark plug offers considerable advantages. For example, the glaze applied to the insulator core nose reduces carbon fouling of the spark plug during the manufacture of automobiles in which the spark plug is installed. The glaze also alleviates carbon fouling problems associated with direct injection engines. Yet another benefit of the glaze is that it does not burn off during normal use.

Another advantage is offered during bulk handling of the spark plugs and insulator core assemblies, where the insulator core noses may be contacted by materials that may cosmetically blemish the outer surfaces with metal marks and dirt or grease stains. The glaze protects the outer surface from such marks and stains. The glaze also prevents damage to the insulator core nose such as chips, cracks, and dielectric punctures, during manufacture.

Other features and advantages will become apparent from the following description, including the drawings, and from the claims.

BRIEF DESCRIPTION OF THE INVENTION

Figure 1:
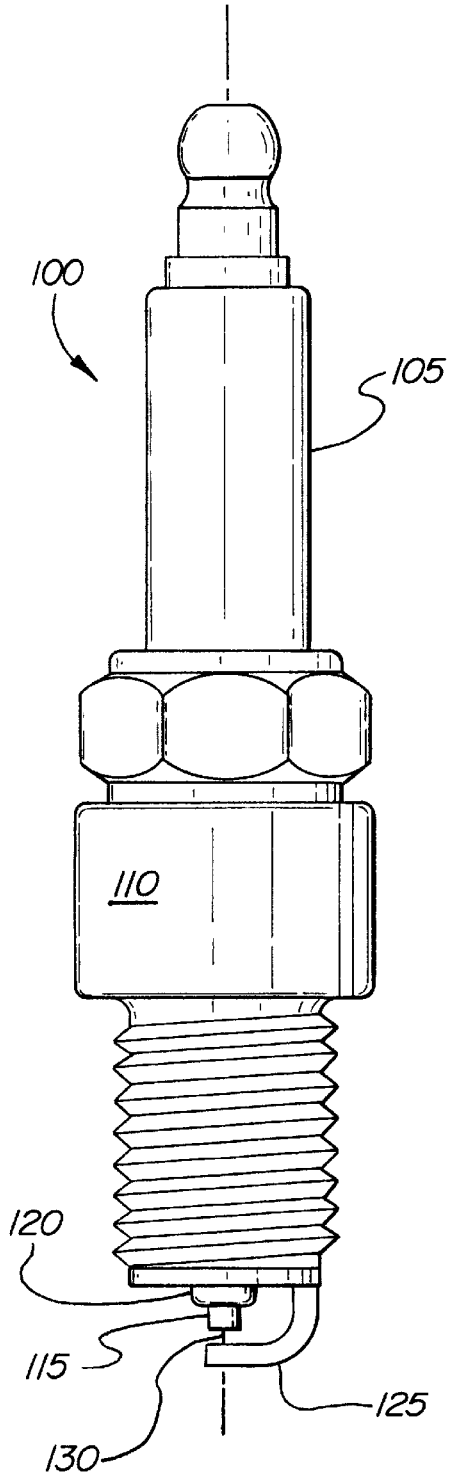
FIG. 1 is a front view of a spark plug.

Referring to FIG. 1, a spark plug 100 includes an insulator core 105 and an outer shell 110. A firing center electrode 115 extends from an insulator core nose 120 and a ground electrode 125 extends from the outer shell, with the electrodes being positioned to define a spark plug gap 130. When the spark plug is installed in an engine, the spark plug gap is located in a combustion chamber of the engine.

Figure 2:
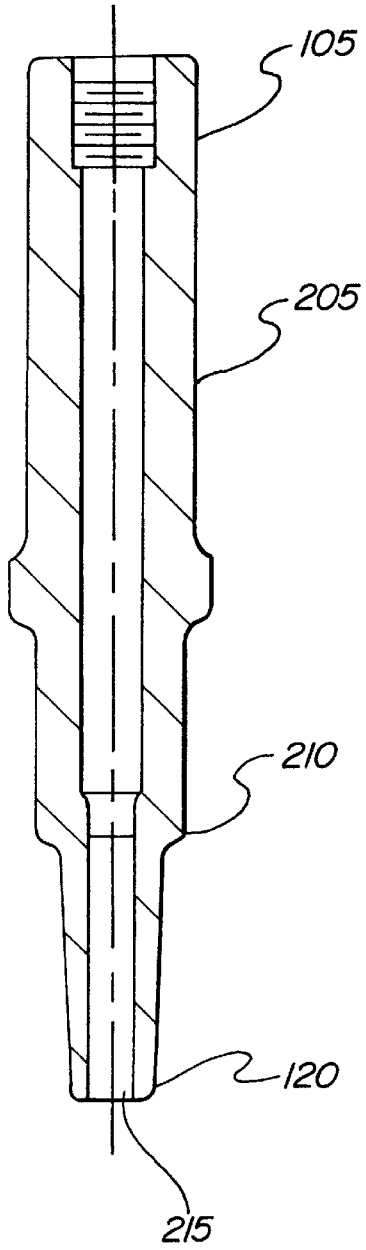
FIG. 2 is a front cross-sectional view of an insulator assembly of the spark plug of FIG. 1.

Referring to FIG. 2, insulator core 105 includes insulator core nose 120, an insulator cap section 205, a shell seat section 210, and a central bore 215. Central bore 215 is configured to receive and retain firing center electrode 115. Insulator core 105 is made from a ceramic material that includes alumina.

A high temperature glaze is applied to core nose 120. The glaze includes (i) between about 72 and 84% $SiO_2$; (ii) between about 10 and 20% $Al_2O_3$; (iii) between about 2.0 and 2.5% $K_2O$; (iv) between about 0.50 and 0.65% $Na_2O$; (v) between about 3.0 and 5.5% CaO; (vi) between about 0.1 and 0.25% MgO; and (vii) the remainder impurities. More specifically, the glaze may include (i) between about 75 and 81% $SiO_2$; (ii) between about 11 and 17% $Al_2O_3$; (iii) between about 2.0 and 2.2% $K_2O$; (iv) between about 0.55 and 0.62% $Na_2O$; (v) between about 3.3 and 5.0% CaO; (vi) between about 0.12 and 0.17% MgO; and (vii) the remainder impurities. Even more specifically, the glaze may include (i) about 78% $SiO_2$; (ii) about 14% $Al_2O_3$; (iii) about 2% $K_2O$;

(iv) about 0.59% $Na_2O$; (v) about 4% CaO; (vi) about 0.16% MgO; and (vii) the remainder impurities. The impurities may include $Fe_2O_3$ and $TiO_2$.

On a normalized mole fraction basis, described in more detail below, the high temperature glaze includes (i) between about 9 and 14 molecular equivalents of $SiO_2$; (ii) between about 0.9 and 1.6 molecular equivalents of $Al_2O_3$; (iii) between about 0.1 and 0.3 molecular equivalents of $K_2O$; (iv) between about 0.05 and 0.1 molecular equivalents of $Na_2O$; (v) between about 0.6 and 0.8 molecular equivalents of CaO; (vi) between about 0.03 and 0.04 molecular equivalents of MgO; and (vii) the remainder impurities. The high temperature glaze may further include, on a normalized mole fraction basis, (i) about 11.7 molecular equivalents of $SiO_2$; (ii) about 1.3 molecular equivalents of $Al_2O_3$; (iii) about 0.2 molecular equivalents of $K_2O$; (iv) about 0.1 molecular equivalents of $Na_2O$; (v) about 0.7 molecular equivalents of CaO; (vi) about 0.04 molecular equivalents of MgO; and (vii) the remainder impurities.

Because the core nose is located in a combustion chamber of an engine during use of the spark plug, the glaze must withstand temperatures as high as 1600° F. for extended periods without softening or burning off. Although most conventional spark plug glazes have anti-carbon buildup properties, they eventually soften and burn off at sustained engine temperatures. Thus, glazes that may otherwise prevent carbon buildup generally are not useful on the core nose because of their inability to be used in an engine at high temperatures.

A second glaze is usually applied to insulator cap section 205. However, because insulator cap section 205 is not positioned within the combustion chamber, the second glaze is a low temperature glaze that does not need to withstand temperatures as high as 1600° F.

Figure 3:
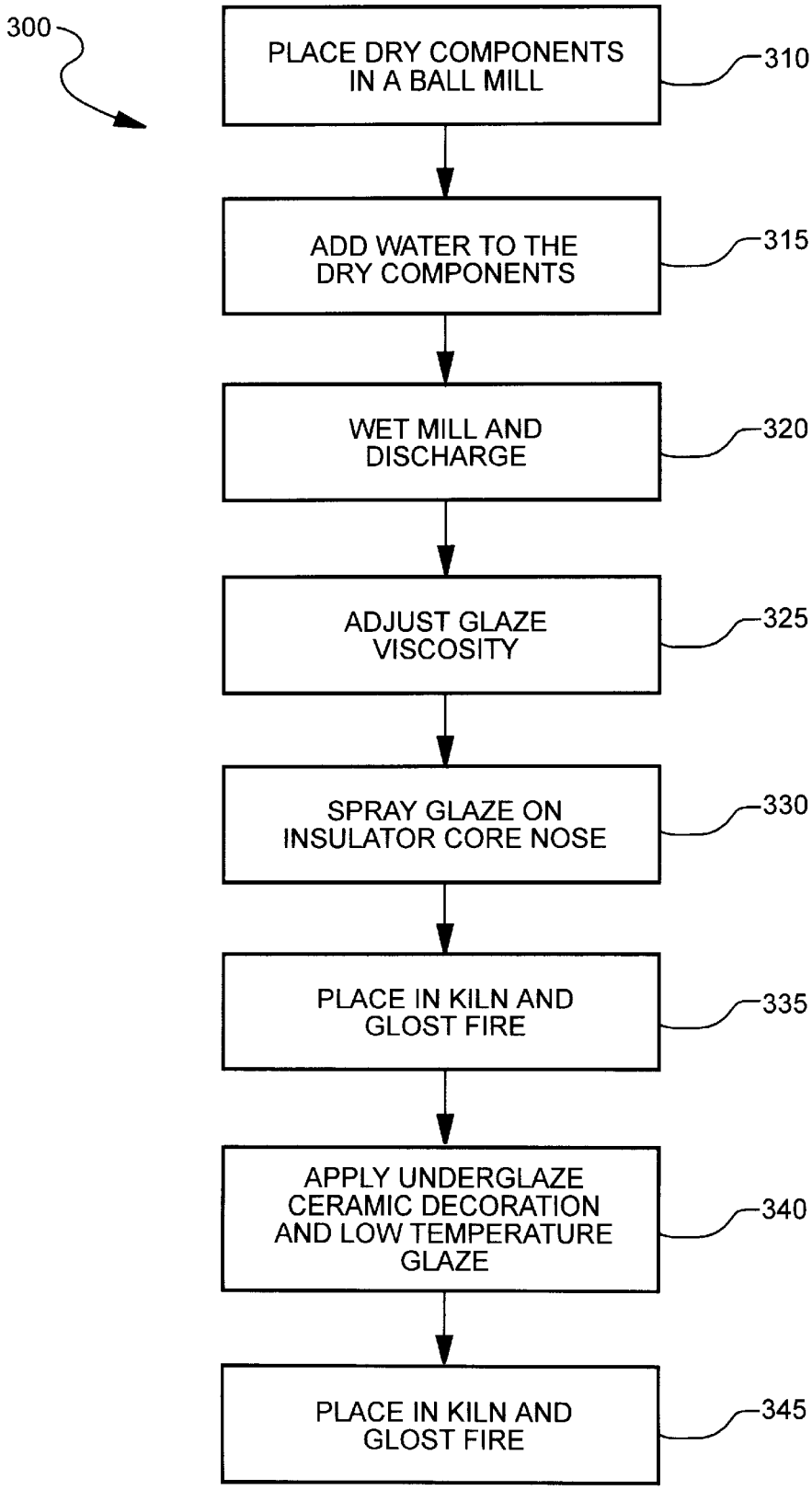
FIG. 3 is a flow chart of a process for applying a high temperature glaze to the insulator assembly of FIG. 2.

Referring to FIG. 3, a process 300 for preparing an insulator core includes preparing a glaze by blending and milling dry glaze components to form a slurry. For example, one formulation of the high-temperature glaze applied to core nose 120 has a raw formulation by weight of approximately 48% silica, 17.1% potash feldspar, 15.7% primary kaolinite clay, 10% secondary kaolinite clay, 2% ball clay, 7.2% calcium carbonate, and 0.025% dye. The silica is available as TAMMS No. 68 Silica from TAMMS Industries Company of Kirkland, Ill. The potash feldspar is available as Custer Feldspar from Pacer Corporation of Custer, S.D. The primary kaolinite clay is available as Avery Primary Kaolin from Harris Mining Corporation of Spruce Pine, N.C. The secondary kaolinite clay is available as E.P.K. Kaolin from the Feldspar Corporation of Atlanta, Ga. Ball Clay is available from numerous suppliers of generic ball clay. The calcium carbonate is available as Hubercarb Q325 calcium carbonate from the J. M. Huber Corporation of Norcross, Ga. The dye is available as Water Blue M Dye from Chemcentral/Detroit of Romulus, Mich.

To prepare the glaze, the dry ingredients are placed in a traditional ball mill with a high-$Al_2O_3$ lining and grinding media (step 310). For a 64 kilogram dry ingredient charge, a 52 gallon ball mill is used with grinding media of approximately 200 kilograms of graded 1-inch diameter high-$Al_2O_3$ mill balls. Approximately 54 kilograms of water are added to the dry mixture to form the glaze (step 315). The glaze is wet-milled for approximately four hours and discharged (step 320).

After wet-milling, the viscosity of the slurry is adjusted (step 325) for spraying onto the insulator core nose 120. To decrease the viscosity of the slurry, water is added. To increase the viscosity, water is decanted after letting the slurry sit and solids settle. The specific gravity also is monitored.

The glaze is applied to the insulator core nose 120 in a spraying operation (step 330). In the spraying operation, insulator core nose 120 is mounted on a rotating spindle and the glaze is sprayed on the insulator core nose as it rotates. The glaze forms a film on the core nose. The core nose may be heated during the spraying operation to facilitate drying of the film as it is applied. The dried glaze adds approximately 8 to 10 mils to the diameter of the insulator core nose 120, or approximately 4 to 5 mils radially to the thickness at any point along its circumference.

The insulator core 105 is then placed in a kiln and glost fired at a nominal temperature of 2700° F. for approximately 10–25 minutes (step 335), after which the application of the glaze is complete. The theoretical fired glaze composition by weight percent is 78.48% $SiO_2$, 14.41% $Al_2O_3$, 2.10% $K_2O$, 0.59% $Na_2O$, 4.26% CaO, and 0.16% MgO. These percentages do not take into account any volatilization of oxide components during the glost firing operation. The glaze composition has a thermal expansion coefficient of $2.7\times10^{-6}$ inches per inch per ° C., a Littleton Softening Point of 1635° F., and, thus, a maximum use temperature above 1600° F.

To complete the insulator core 105, an underglaze ceramic decoration and the low-temperature glaze are applied to the insulator core (step 340). The low-temperature glaze is applied by spraying or by a fountain or roll-on "waterfall" method, which is well-known in the art of manufacturing spark plugs. Following application of the low-temperature glaze, the insulator is glost fired at 2060° F. to mature the low-temperature glaze (step 345).

The insulator assembly is then assembled into a spark plug by inserting the firing center electrode 115 in central bore 215 and inserting the insulator core 105 in outer shell 110.

Table I sets forth the overall net compositional ranges of components for the high-temperature glaze. Formulae listed in Table I represent fired compositions, disregarding volatilization, if any, of oxide ingredients during glost firing.

TABLE I

4299 HIGH-TEMPERATURE GLAZE COMPOSITION FOR ALUMINA CERAMICS NOMINAL FIRED OXIDE FORMULATION

| OXIDE | PERCENT BY WEIGHT |
|---|---|
| $SiO_2$ | 78.48 |
| $Al_2O_3$ | 14.41 |
| $K_2O$ | 2.10 |
| $Na_2O$ | 0.59 |
| CaO | 4.26 |
| MgO | 0.16 |
| $Fe_2O_3$ $TiO_2$ | Trace |
| TOTAL | 100.00 |

Four other formulations (Formulations A–D) of a high temperature glaze were processed as described above. Formulations A–D have nominal fired oxide formulations as set forth in Table II. Formulae listed in Table II represent fired compositions, disregarding volatilization, if any, of oxide ingredients during glost firing.

TABLE II

HIGH-TEMPERATURE GLAZE COMPOSITIONS 4299 AND EXAMPLES A–D NOMINAL AND OVERALL NET RANGES OF COMPONENTS IN WEIGHT PERCENT

| OXIDE | PERCENT BY WEIGHT (NOMINAL RANGE) | PERCENT BY WEIGHT (OVERALL NET RANGE) |
|---|---|---|
| $SiO_2$ | 75.5 to 81.5 | 75.74 to 81.17 |
| $Al_2O_3$ | 11.5 to 17.5 | 11.82 to 17.06 |
| $K_2O$ | 2.0 to 2.2 | 2.07 to 2.12 |
| $Na_2O$ | 0.55 to 0.65 | 0.58 to 0.60 |
| CaO | 3.0 to 5.5 | 3.37 to 5.04 |
| MgO | 0.10 to 0.25 | 0.13 to 0.19 |
| Minor Impurities $Fe_2O_3$ $TiO_2$ | Trace | Trace |

It is evident from Table I and Table II that the glazes are high in silica and alumina, individually and together, relative to other glazes. The relatively high combined weight percentages of these two components, i.e., approximately 92–94%, contribute to the high refractory property of the glazes as compared to conventional glazes, i.e., those having 40–50% by weight silica and alumina. Although Tables I and II provide specific examples, the high temperature glaze can have a composition within the following weight percent ranges: 72.0 to 84.0 $SiO_2$, 10.0 to 20.0% $Al_2O_3$, 2.0 to 2.5% $K_2O$, 0.50 to 0.65% $Na_2O$, 3.0 to 5.5% CaO, 0.10 to 0.25% MgO, and trace amounts of $Fe_2O_3$ and $TiO_2$. These percentages do not take into account any volatilization of oxide components during the glost firing operation.

It will be appreciated that the ultimate composition of the above glazes, containing six or more oxides, is complex. Nonetheless, even though it is not possible to predict quantitatively the behavior of a glaze, it is desirable that some degree of comprehension and control be achieved.

The raw materials of glazes are almost always oxides or compounds that can be expressed as oxides, thus enabling the components to be described in terms of phase compositions having known characteristics. Because of this, glaze ceramists commonly use a system of expressing oxide compositions in terms of molar proportions, i.e., molecular equivalents. By means of molecular equivalents, an empirical oxide formula can be calculated for each glaze composition.

For purposes of arriving at an empirical molecular formula, all oxides are classified as either basic, neutral (amphoteric), or acid. The glaze oxides which are classified as bases, that is, the alkali metal and alkaline earth oxides, are designated as "$R_2O$" and "RO" respectively. The neutral or amphoteric oxides are designated as "$R_2O_3$" and acid oxides are designated as "$RO_2$."

On an empirical molecular formula basis, the glaze compositions set forth for glaze 4299 in Table I and for Formulations A–D in Table II are shown in Table III and Tables IV–VII, respectively, below:

TABLE III

4299 HIGH-TEMPERATURE GLAZE COMPOSITION CHEMICAL ANALYSIS/OXIDE FORMULATION

| CHEMISTRY | | Weight | Molecular | MOLES (Wt./ | "Normalized" Mole |
|---|---|---|---|---|---|
| Oxide | Symbol | % | Weight | Molecular Wt.) | Fraction |
| $SiO_2$ | $RO_2$ | 78.48 | 60.1 | 1.305823 | 11.688878 |
| $Al_2O_3$ | $R_2O_3$ | 14.41 | 102.0 | 0.141275 | 1.264602 |
| $K_2O$ | $R_2O$ | 2.10 | 94.2 | 0.022293 | 0.199552 |
| $Na_2O$ | $R_2O$ | 0.59 | 62.0 | 0.009516 | 0.085181 |
| CaO | RO | 4.26 | 56.1 | 0.075936 | 0.679730 |
| MgO | RO | 0.16 | 40.3 | 0.003970 | 0.035537 |
| Minor Impurities $TiO_2$, $Fe_2O_3$ | | Trace | N/A | N/A | N/A |

TABLE IV

FIRED "A" HIGH-TEMPERATURE GLAZE COMPOSITION CHEMICAL ANALYSIS/OXIDE FORMULATION

| CHEMISTRY | | Weight | Molecular | MOLES (Wt./ | "Normalized" Mole |
|---|---|---|---|---|---|
| Oxide | Symbol | % | Weight | Molecular Wt.) | Fraction |
| $SiO_2$ | $RO_2$ | 81.17 | 60.1 | 1.350582 | 12.267201 |
| $Al_2O_3$ | $R_2O_3$ | 11.82 | 102.0 | 0.115882 | 1.052544 |
| $K_2O$ | $R_2O$ | 2.07 | 94.2 | 0.021975 | 0.199597 |
| $Na_2O$ | $R_2O$ | 0.58 | 62.0 | 0.009355 | 0.084971 |
| CaO | RO | 4.21 | 56.1 | 0.075045 | 0.681626 |
| MgO | RO | 0.15 | 40.3 | 0.003722 | 0.033807 |
| Minor Impurities $TiO_2$, $Fe_2O_3$ | | Trace | N/A | N/A | N/A |

TABLE V

FIRED "B" HIGH-TEMPERATURE GLAZE COMPOSITION CHEMICAL ANALYSIS/OXIDE FORMULATION

| CHEMISTRY | | Weight | Molecular | MOLES (Wt./ | "Normalized" Mole |
|---|---|---|---|---|---|
| Oxide | Symbol | % | Weight | Molecular Wt.) | Fraction |
| $SiO_2$ | $RO_2$ | 75.74 | 60.1 | 1.260233 | 11.130146 |
| $Al_2O_3$ | $R_2O_3$ | 17.06 | 102.0 | 0.167255 | 1.477165 |
| $K_2O$ | $R_2O$ | 2.12 | 94.2 | 0.022505 | 0.198760 |
| $Na_2O$ | $R_2O$ | 0.60 | 62.0 | 0.009677 | 0.085465 |
| CaO | RO | 4.31 | 56.1 | 0.076827 | 0.678522 |
| MgO | RO | 0.17 | 40.3 | 0.004218 | 0.037253 |
| Minor Impurities $TiO_2$, $Fe_2O_3$ | | Trace | N/A | N/A | N/A |

TABLE VI

FIRED "C" HIGH-TEMPERATURE GLAZE COMPOSITION CHEMICAL ANALYSIS/OXIDE FORMULATION

| CHEMISTRY | | Weight | Molecular | MOLES (Wt./ | "Normalized" Mole |
|---|---|---|---|---|---|
| Oxide | Symbol | % | Weight | Molecular Wt.) | Fraction |
| $SiO_2$ | $RO_2$ | 79.53 | 60.1 | 1.323295 | 13.96868 |
| $Al_2O_3$ | $R_2O_3$ | 14.31 | 102.0 | 0.140294 | 1.480941 |
| $K_2O$ | $R_2O$ | 2.08 | 94.2 | 0.022081 | 0.233087 |
| $Na_2O$ | $R_2O$ | 0.58 | 62.0 | 0.009355 | 0.098751 |
| CaO | RO | 3.37 | 56.1 | 0.060071 | 0.634108 |

TABLE VI-continued

FIRED "C" HIGH-TEMPERATURE GLAZE COMPOSITION CHEMICAL ANALYSIS/OXIDE FORMULATION

| CHEMISTRY | | Weight | Molecular | MOLES (Wt./ | "Normalized" Mole |
|---|---|---|---|---|---|
| Oxide | Symbol | % | Weight | Molecular Wt.) | Fraction |
| MgO | RO | 0.13 | 40.3 | 0.003226 | 0.034054 |
| Minor Impurities $TiO_2$, $Fe_2O_3$ | | Trace | N/A | N/A | N/A |

TABLE VII

FIRED "D" HIGH-TEMPERATURE GLAZE COMPOSITION CHEMICAL ANALYSIS/OXIDE FORMULATION

| CHEMISTRY | | Weight | Molecular | MOLES (Wt./ | "Normalized" Mole |
|---|---|---|---|---|---|
| Oxide | Symbol | % | Weight | Molecular Wt.) | Fraction |
| $SiO_2$ | $RO_2$ | 77.57 | 60.1 | 1.290682 | 10.205440 |
| $Al_2O_3$ | $R_2O_3$ | 14.50 | 102.0 | 0.142157 | 1.124037 |
| $K_2O$ | $R_2O$ | 2.11 | 94.2 | 0.022399 | 0.177109 |
| $Na_2O$ | $R_2O$ | 0.59 | 62.0 | 0.009516 | 0.075243 |
| CaO | RO | 5.04 | 56.1 | 0.089840 | 0.710366 |
| MgO | RO | 0.19 | 40.3 | 0.004715 | 0.037282 |
| Minor Impurities $TiO_2$, $Fe_2O_3$ | | Trace | N/A | N/A | N/A |

In establishing the empirical formula for a glaze, the formula is "normalized" so that the sum of the normalized mole fraction of $R_2O$ and RO is brought to unity. In the 4299 glaze, the sum of the moles of RO and $R_2O$ (i.e., the factor) equals 0.111715. Dividing each of the "MOLES" obtained by the factor establishes the empirical formula of the glaze, given in the last column as "Normalized Mole Fraction." By means of the empirical formula, the calculation of batch weights or the determination of the proportions of ingredients required to produce a glaze having a given formula is simplified, especially if it is desired to formulate the glaze from compounds other than oxides, such as for example, carbonates. Comparison of glaze formulations is thereby greatly simplified.

In Table III, the sum of the RO and $R_2O$ groups equals 1.00 (unity) and has a factor of 0.111715. In Table IV, the sum of the RO and $R_2O$ groups equals 1.00 and has a factor of 0.110097. In Table V, the sum of the RO and $R_2O$ groups equals 1.00 and has a factor of 0.113227. In Table VI, the sum of the RO and $R_2O$ groups equals 1.00 and has a factor of 0.094733. In Table VII, the sum of the RO and $R_2O$ groups equals 1.00 and has a factor of 0.126470.

In general, the high temperature glazes may be applied to any high alumina ceramic substrate that is typically coated with a glaze. In particular, the glazes are well-suited for ceramic substrates to which a buildup of carbon or other material is undesirable, such as spark plug insulator cores. Other applications include chemical labware, washers, spacers, tubes, electrical circuit components, sound insulation tubes, etc.

Other implementations are within the scope of the following claims.

What is claimed is:

1. A spark plug (100) comprising:

a ground electrode (125);

a firing electrode (115);

an insulator core (105) having an insulator core nose (120); and an outer shell (110) surrounding the insulator core (105), wherein the improvement comprises the insulator core nose (120) including a high temperature glaze applied to an outer surface of the insulator core nose (120) and the high temperature glaze comprising, by weight:

(i) between about 72 and 84% $SiO_2$;

(ii) between about 10 and 20% $Al_2O_3$;

(iii) between about 2.0 and 2.5% $K_2O$;

(iv) between about 0.50 and 0.65% $Na_2O$;

(v) between about 3.0 and 5.5% CaO;

(vi) between about 0.1 and 0.25% MgO; and (vii) the remainder impurities.

2. The spark plug (100) of claim 1, wherein the high temperature glaze comprises, by weight:

(i) between about 75 and 81% $SiO_2$;

(ii) between about 11 and 17% $Al_2O_3$;

(iii) between about 2.0 and 2.2% $K_2O$;

(iv) between about 0.55 and 0.62% $Na_2O$;

(v) between about 3.3 and 5.0% CaO;

(vi) between about 0.12 and 0.17% MgO; and (vii) the remainder impurities.

3. The spark plug (100) of claim 1, wherein the high temperature glaze comprises, by weight:

(i) about 78% $SiO_2$;

(ii) about 14% $Al_2O_3$;

(iii) about 2% $K_2O$;

(iv) about 0.59% $Na_2O$;

(v) about 4% CaO;

(vi) about 0.16% MgO; and (vii) the remainder impurities.

4. The spark plug (100) of claim 1, wherein the impurities include $Fe_2O_3$ and $TiO_2$.

5. The spark plug (100) of claim 1, wherein the high temperature glaze remains hard at temperatures of approximately 1600° F.

6. The spark plug (100) of claim 1, wherein the high temperature glaze comprises, on a normalized mole fraction basis:

(i) between about 9 and 14 molecular equivalents of $SiO_2$;

(ii) between about 0.9 and 1.6 molecular equivalents of $Al_2O_3$;

(iii) between about 0.1 and 0.3 molecular equivalents of $K_2O$;

(iv) between about 0.05 and 0.1 molecular equivalents of $Na_2O$;

(v) between about 0.6 and 0.8 molecular equivalents of CaO;

(vi) between about 0.03 and 0.04 molecular equivalents of MgO; and (vii) the remainder impurities.

7. The spark plug (100) of claim 1, wherein the high temperature glaze comprises, on a normalized mole fraction basis:

(i) about 11.7 molecular equivalents of $SiO_2$;

(ii) about 1.3 molecular equivalents of $Al_2O_3$;

(iii) about 0.2 molecular equivalents of $K_2O$;

(iv) about 0.1 molecular equivalents of $Na_2O$;

(v) about 0.7 molecular equivalents of CaO;

(vi) about 0.04 molecular equivalents of MgO; and (vii) the remainder impurities.

8. A ceramic insulator core nose (120) having a high temperature glaze on an outer surface, wherein the improvement comprises a glaze composition comprising, by weight:

(i) between about 72 and 84% $SiO_2$;

(ii) between about 10 and 20% $Al_2O_3$;

(iii) between about 2.0 and 2.5% $K_2O$;

(iv) between about 0.50 and 0.65% $Na_2O$;

(v) between about 3.0 and 5.5% CaO;

(vi) between about 0.1 and 0.25% MgO; and (vii) the remainder impurities.

9. The ceramic insulator core nose (120) of claim 8, wherein the glaze composition comprises, by weight:

(i) between about 75 and 81% $SiO_2$;

(ii) between about 11 and 17% $Al_2O_3$;

(iii) between about 2.0 and 2.2% $K_2O$;

(iv) between about 0.55 and 0.62% $Na_2O$;

(v) between about 3.3 and 5.0% CaO;

(vi) between about 0.12 and 0.17% MgO; and (vii) the remainder impurities.

10. The ceramic insulator core nose (120) of claim 8, wherein the glaze composition comprises, by weight:

(i) about 78% $SiO_2$;

(ii) about 14% $Al_2O_3$;

(iii) about 2% $K_2O$;

(iv) about 0.59% $Na_2O$;

(v) about 4% CaO;

(vi) about 0.16% MgO; and (vii) the remainder impurities.

11. The ceramic insulator core nose (120) of claim 8, wherein the impurities include $Fe_2O_3$ and $TiO_2$.

12. The ceramic insulator core nose (120) of claim 8, wherein the glaze does not soften at temperatures of approximately 1600° F.

13. A method of making a spark plug (100) having a high temperature glaze applied to an insulator core nose (120) comprising:

providing an outer shell (110);

providing an insulator core (105) having the insulator core nose (110);

providing the high temperature glaze comprising, by weight:

(i) between about 72 and 84% $SiO_2$;

(ii) between about 10 and 20% $Al_2O_3$;

(iii) between about 2.0 and 2.5% $K_2O$;

(iv) between about 0.50 and 0.65% $Na_2O$;

(v) between about 3.0 and 5.5% CaO;

(vi) between about 0.1 and 0.2% MgO; and (vii) the remainder impurities; and inserting the insulator core (105) in the outer shell (110), wherein the improvement comprises applying the high temperature glaze to the insulator core nose (120).

14. The method of claim 13, wherein the glaze composition comprises, by weight:

(i) between about 75 and 81% $SiO_2$;

(ii) between about 11 and 17% $Al_2O_3$;

(iii) between about 2.0 and 2.2% $K_2O$;

(iv) between about 0.55 and 0.62% $Na_2O$;

(v) between about 3.3 and 5.0% CaO;

(vi) between about 0.12 and 0.17% MgO; and (vii) the remainder impurities.

15. The method of claim 13, wherein the glaze composition comprises, by weight:

(i) about 78% $SiO_2$;

(ii) about 14% $Al_2O_3$;

(iii) about 2% $K_2O$;

(iv) about 0.59% $Na_2O$;

(v) about 4% CaO;

(vi) about 0.16% MgO; and (vii) the remainder impurities.

16. The method of claim 13, wherein the impurities include $Fe_2O_3$ and $TiO_2$.

17. The method of claim 13, wherein the glaze does not soften at temperatures of approximately 1600° F.

18. The method of claim 13, further comprising firing the insulator core nose (120) after applying the glaze to the insulator core nose (120).

19. The method of claim 18, wherein the insulator core nose (120) is fired at a temperature of approximately 2700° F.

* * * * *